US005090770A

United States Patent [19]

Heinrichs et al.

[11] Patent Number: 5,090,770

[45] Date of Patent: Feb. 25, 1992

[54] ELECTRICAL SEAT ADJUSTMENT DEVICE

[75] Inventors: Heinz-Josef Heinrichs, Koblenz-Metternich; Stephan Enders, Koblenz; Udo Wagner, Dachsenhausen; Alfred Dirksen, Wesseling, all of Fed. Rep. of Germany

[73] Assignee: Stabilus GmbH, Koblenz-Neuendorf, Fed. Rep. of Germany

[21] Appl. No.: 510,555

[22] Filed: Apr. 18, 1990

[30] Foreign Application Priority Data

Apr. 27, 1989 [DE] Fed. Rep. of Germany ..... 3913849

[51] Int. Cl.[5] ..... A47C 1/02

[52] U.S. Cl. ..... 297/347; 267/64.12; 188/300; 297/361

[58] Field of Search ..... 297/345, 347, 284, 330, 297/361; 248/161, 157, 419, 575, 407; 267/64.12; 188/300

[56] References Cited

U.S. PATENT DOCUMENTS 3,559,776 2/1971 Schultze ..... 188/300 X
4,245,826 1/1981 Wirges ..... 297/345 X
4,257,582 3/1981 Wirges ..... 297/345 X
4,379,588 4/1983 Speice ..... 297/349 X
4,655,505 4/1987 Kashiwamura et al. ..... 297/330 X

FOREIGN PATENT DOCUMENTS 1034347 6/1966 United Kingdom ..... 267/64.12
1164155 9/1969 United Kingdom ..... 188/300

*Primary Examiner*—Peter A. Aschenbrenner
*Attorney, Agent, or Firm*—Brumbaugh, Graves, Donohue & Raymond

[57] ABSTRACT

In the case of an item of seating furniture, particularly an office chair, comprising at least one seat adjusting device, for example for adjusting the height of the seat, with a spring element engaging the two parts of the seat which are to be adjusted in respect of each other, particularly a pressurized fluid filled spring, and with a locking device for the separable fixing of the two seat parts in whatever is the desired and selected adjusted position, the use of an electrical actuating element for the locking device is proposed, which is connected to a manually operable control means for the at least one seat adjustment, this allowing simplified operation with minimal structural expenditure.

26 Claims, 2 Drawing Sheets

ELECTRICAL SEAT ADJUSTMENT DEVICE

BACKGROUND OF THE INVENTION

1. Field of the Invention

The invention relates to an item of seating furniture, particularly an office chair, comprising at least one seat adjusting device, for example for adjusting the seat height, with, engaging the two parts of the seat which have to be adjusted in respect of each other, a spring element, particularly a pressurized fluid spring, and comprising a locking device for the separable possibly resiliently yielding fixing of the two seat parts in whichever adjusted position is chosen.

2. Description of the Prior Art

In the case of known types of seating furniture of this type, the desired adjusted position of the seat is achieved in that, starting from an initial adjustment of the seat with the spring element in its maximum relaxed state (seat raised to its highest setting; back rest pivoted forwards), the person sitting on the seat releases the locking device of the corresponding seat adjusting device, for example the seat height adjusting device, whereupon the seat padding is lowered under the body weight until finally, when the desired height is reached, the person in question releases the lever of the locking device so that it returns to its locked position and the seat is fixed at the desired height. The seat back is adjusted in a corresponding manner. Where many office chairs are concerned, still further adjustment possibilities are available such as, for example, the angle of inclination of the seat and adjustment of the height of the back rest cushion, for which purpose a corresponding plurality of actuating elements such as, for example, levers are provided on the chair. For technically unskilled persons, difficulties frequently occur in achieving an optimum adjustment of the seat parameters.

In motor vehicles, seat adjustment-devices are known which make it possible to approach the desired seat position with the aid of electrical adjusting drives. Such electrical adjusting drives are inappropriate in the case of seating furniture such as, for example, office chairs on grounds of cost. Also, such positioning motors require relatively considerable energy so that items of seating furniture would have to be connected to external voltage sources such as, for example, to the main network, which would result in restricted freedom of movement.

SUMMARY OF THE INVENTION

The problem on which the invention is based resides in providing an item of seating furniture of the type mentioned at the outset which offers simplified operation and at the same time simple and favorably costed construction.

The problem is resolved by an electrical actuating element for the locking device and connected to a manually operable electrical control means for the at least one seat adjustment. According to the invention, therefore, instead of an electric motor carrying out the adjustment, only an electrical actuating element is provided for the locking device and this can be produced at a favorable cost and consumes comparatively little energy. The actuating element is operated via the manually operable control means. Therefore, push button adjustment of the seat is readily possible. Return of the seat to its initial seat adjusted position takes place as previously via the spring element, particularly the pressurized fluid-filled spring, by corresponding momentary release of the locking device. Approach to whatever adjusted position is required is effected under the loading of the person on the seat, against the force of the spring element, or alternatively by reason of the force of the spring element when the seat is correspondingly unloaded by a corresponding operation of the electrical actuating element for the locking device by means of the manually operable electrical control means. The locking device is correspondingly maintained released until such time as the desired adjusted position is reached. Therefore, no electric motor is required to carry out the adjusting movement.

An advantageous further development of the invention is characterized by an optionally accessible position memory for the position signal given by the position signal generator. In this way, it is possible in turn and with negligible structural cost to improve the operating potential of the item of seating furniture since now optimum settings of the seat can be stored and can also be accessed for repeated setting of the optimum positions.

A further development of the invention envisages that the position memory is constructed to store and for optionally accessing at least two different position signals from the position signal generator. This makes it possible to store the optimum settings for several persons in such a way that they can be accessed. If, for instance, a work place is shared by two workers, then they can rapidly and reliably access their individual optimum office chair settings.

Reliable functioning combined with simple construction and minimal energy are guaranteed if the electrical actuating element consists of a lifting magnet.

The item of seating furniture becomes completely independent of external voltage sources if it has solar cells to supply current to the at least one seat adjustment device. These are preferably mounted on the outside of the back rest since sufficient free space is available there.

In order also that the electrical control means can carry out a seat adjustment according to the invention in temporarily inadequate lighting conditions, particularly at night, it is proposed that a storage battery be connected to the solar cells. In another embodiment of the invention, the storage batteries can also be charged by the chair being briefly connected to a domestic power socket, so that during normal operation, there do not need to be any wires connecting the seating furniture and the power socket. Examples of pre-tensioning elements are coil springs, but the use of a piston rod-cylinder unit, particularly a gas-filled spring, is especially preferred since in the case of a central chair column, such a unit can, in addition to performing the spring function, also take over the guidance function and possibly the locking function.

In order to be able to use simple electronic means and quickly and reliably ascertain the relevant adjusted position, it is suggested that the position signal generator comprises an electrical oscillating circuit of a capacitance or inductance which is variable as a function of the relevant position which has to be adjusted. By adjusting the seat position, therefore, there is a corresponding variation in the resonance frequency of the oscillating circuit. The resonance frequency at any given time can be ascertained in conventional manner by analogue or digital means, particularly by means of counters.

In this respect, it is envisaged that the position signal generator comprises a capacitor of variable capacitance consisting of two inter-engaged partially overlapping hollow cylinder capacitor plates, one of which is coupled for movement with in each case one of the two seat parts. A coaxial disposition of the two hollow cylinder capacitor plates in respect of the piston rod-cylinder unit is especially preferred. This makes for a compact construction and a high level of sensitivity.

A separate inner capacitor plate is dispensed with if this inner capacitor plate is formed by the cylinder of the piston rod-cylinder unit and if the outer capacitor plate is formed by a metal sleeve connected to the outer end of the piston rod. This particularly compact development is preferably used for adjustment of the back rest.

With regard to the central column of the chair, it is frequent practice to use, mounted on the cruciform base, a tubular pillar which encloses the downwardly projecting piston rod, which is mounted on the cruciform base and, to a certain extent, the cylinder. With this arrangement, it is suggested that the inner capacitor plate should be formed by the tubular pillar connected to the outer end of the piston rod while the outer capacitor plate is formed by a metal sleeve connected to that end of the cylinder which is remote from the outer end of the piston rod. Here, too, it is possible to save on a separate inner capacitor plate.

As a further protection for the piston-rod cylinder unit and of the outer capacitor plate, it is proposed that the metal sleeve be disposed within a protective tube with an insulating layer between the metal sleeve and the protective tube. The protective tube is preferably earthed so that it serves as an electrical screening (Faraday's cage), which makes the measurement of capacitance both more reliable and also prevents the irradiation of interference pulses (radioshielding such as is required, for example, by the German Federal Post Office).

In a favorable costed embodiment of the invention a copper foil is used as the metal sleeve and a layer of foam, preferably polyurethane foam, is used as the insulating layer.

In order to prevent a capacitor short-circuit while at the same time increasing the capacitance, it is proposed that one of the capacitor plate surfaces be provided with an insulating coating, preferably in the form of a synthetic plastics film, the insulating coating preferably being a coating of PTFE.

The electronic control means is adequately accommodated in the seat part of the seating furniture, particularly the office chair. The electrical connection of the tubular pillar mounted on the chair stand, particularly the cruciform chair base (swivel chair), to the electrical control means preferably takes place then via the cylinder of the piston rod-cylinder unit. The electrically conductive connection of those parts which are movable in relation to each other is preferably effected via a sliding or rolling contact which applies pressure to the outer periphery of the cylinder.

The piston rod-cylinder unit preferably consists of a gas-filled spring with an at least partial filling of pressurized gas, with a communicating passage between the partial spaces separated from one another by the piston within the interior space in the cylinder and with an optionally operable shut-off valve in the communicating passage. The pressurized gas filling provides the pretensioning force required to approach the initial adjusted position and which also permits of an instant resilient yielding of the seat in whichever is the selected adjusted position when the person in question takes place on the seat.

In order to ensure operational capability of the at least one seat adjusting device when the control means fails, it is proposed that the shut-off valve be capable of being actuated optionally by electrical or by direct manual means.

It is possible to use two such gas-filled springs, one for adjusting the seat height and the other for adjusting the angle of rake of the back rest, both being connected to the control means which is common to the two of them. The use of further gas-filled springs is conceivable, particularly for adjusting the height of the back rest cushion.

A further development of the invention is characterized by a key pad connected to the control means and provided in order to operate the at least one seat adjusting device and which is preferably integrated into an arm rest.

It is furthermore suggested that, upon actuation of a first selected key on the key pad the position signal of the respective position signal generator should be stored in the position memory. In a starting seat adjusting position with the spring element of the at least one seat adjusting device in a stage of maximum tension or maximum relaxation, and with a seating adjusting device under load (particularly weight of a person seated on the item of seating furniture) or relieved of this load, and upon actuation of a second key selection of the key pad, the stored position signal is read as a position signal desired value and is compared with the actual position signal which is generated at that moment by the position signal generator as the actual value of the position signal. Thereupon, the locking device is moved by the electrical actuating element out of its locked position and into its released position and is held in the released position in the course of the adjusting movement of the at least one seat adjusting device only until the moment, in which the actual value of the position signal corresponds substantially to the desired value of the position signal.

The invention also relates to a piston rod-cylinder unit, particularly a gas-filled spring, for an item of seating furniture of the type described hereinabove with an integrated electrical actuating element. In this respect, it is possible for a lifting magnet forming the actuating element to be provided within the cylinder tube at the end of the cylinder tube which is remote from the free end of the piston rod and which engages a valve pin on the shut-off valve in the communicating passage.

The various features of novelty which characterize the invention are pointed out with particularity in the claims annexed to and forming part of the dislcosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Described hereinafter is the application of the invention to an office chair of the swivel type, although the use of the invention is not limited to such items of furniture. Whenever the item of seating furniture is intended to be adjustable in order to adapt to the desired sitting conditions, it is possible for the invention to be advantageously used since it manages without expensive and much electrical power consuming adjusting motors. In fact, the spring elements which are already incorporated in many cases, particularly gas-filled springs, are used in the usual way, namely for adjusting the seat to a starting position and for moving the respective seat parts to the desired position by an appropriate momentary releasing of the locking device. Therefore, this latter movement takes place as a result of the spring action and the loading (body weight) or unloading of the seat. According to the invention, the approach to the desired and possibly already previously ascertained and memory-stored adjusted position is carried out by a corresponding actuation of an electrical actuating element associated with the locking device. Therefore, this provides for many possible applications such as, for example, in the case of television armchairs or the like.

Figure 1:
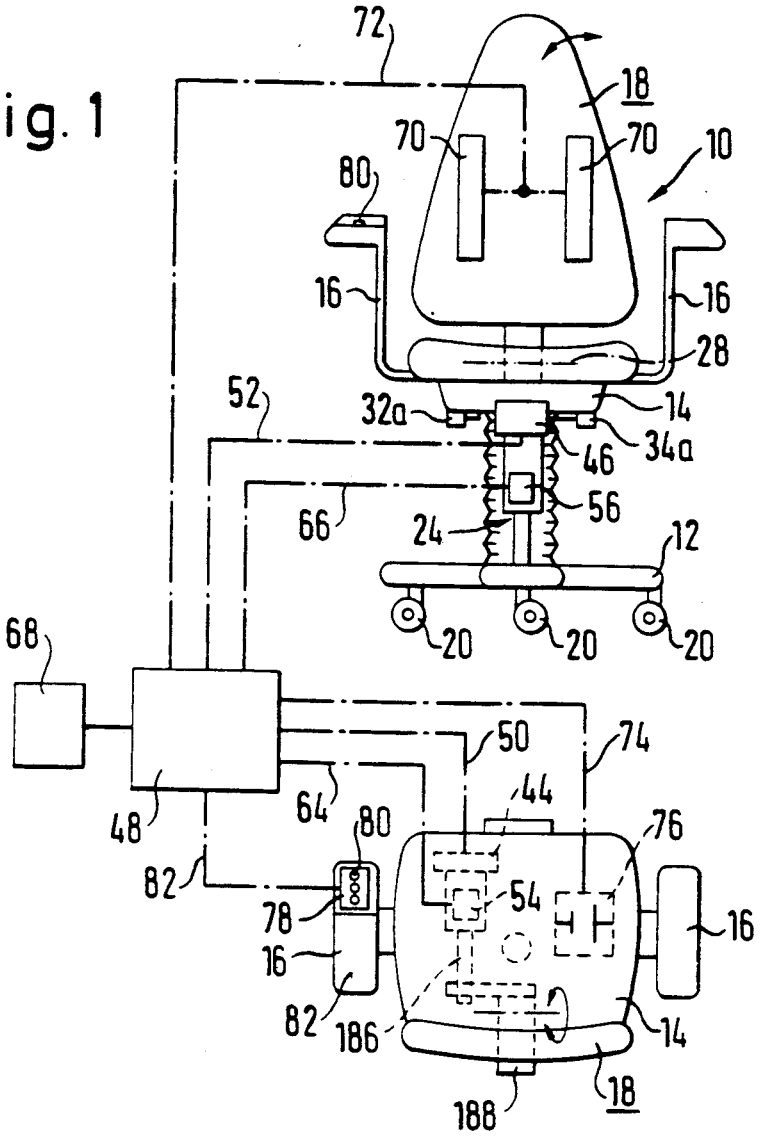
FIG. 1 is a simplified diagrammatic view of an office chair construction in accordance with the invention, viewed from the front and in plan and including an electrical circuit diagram.

FIG. 1 shows an office chair 10 constructed as a swivel chair and provided with a cruciform base 12, a seat 14 with lateral arm rests 16 and with a back rest 18. Mounted on the cruciform chair base 12 are castors 20 which, when stationary use is required, may also be omitted.

Cruciform chair base 12 and seat 14 are connected to each other by a central chair column 24 comprising an adjustable gas-filled spring 22 in such a way that they are adjustable for height while being rotatable in respect of each other about a vertical axis 26. The central chair column 24 is explained hereinafter with reference to FIG. 3.

Figure 2:
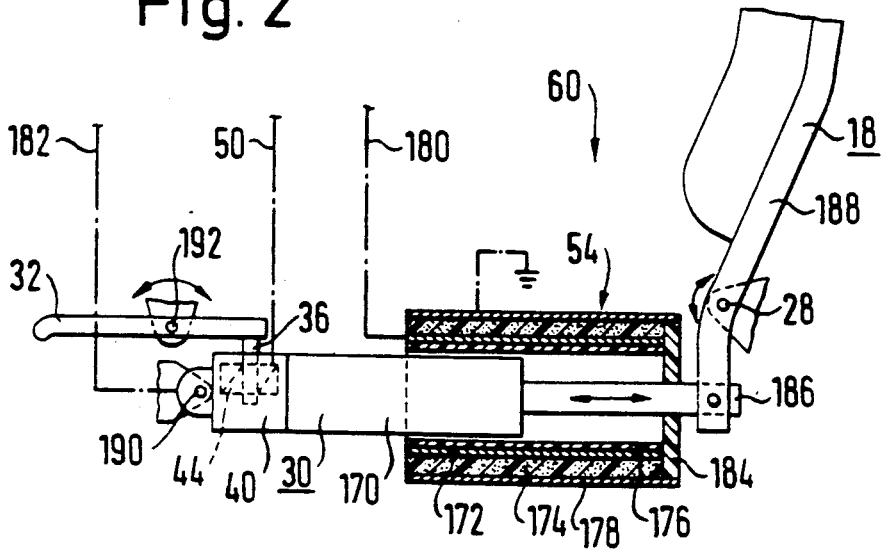
FIG. 2 is a partially sectional side view in detail of the office chair according to FIG. 1 in the region of the back rest rake adjusting device.

The angle of inclination of the back rest 18 can be adjusted (pivoting movement about a horizontal pivoting axis 28 shown in FIGS. 1 and 2), for which purpose the disposition in FIG. 2 is provided. Here, too, an adjustable gas-filled spring 30 is used. Both gas-filled springs 22 and 30 are directly manually adjustable in a conventional manner. This is symbolized in FIGS. 2 and 3 by in each case a manually actuable double-armed lever 32, 34 which in each case acts on an associated valve pin 36, 38 as part of a locking device 40 or 42 integrated into the gas-filled spring for the separable, possibly resilient fixing of the two seat parts which are connected to each other by the gas-filled spring in whichever is the selected adjustable position. Both locking devices 40, 42 can however also be electrically actuated, for which purpose there is associated with both locking devices an electrical actuating element 44, 46, preferably in the form of a lifting magnet acting on the valve pin 36, 38.

Both actuating elements 44, 46 are connected to an electrical control means which is symbolized as a block 48 in FIG. 1. The corresponding connecting wires (dash-dotted lines) are shown as 50 and 52 in the drawings. The control means 48 are integrated in the seat 14 in a manner which is not shown in greater detail.

Furthermore, position signal generators (position transmitters) 54, 56 are connected to the control means 48. The position signal generator 54 is associated with the gas-filled spring 30 of the back rest rake adjusting device 60 according to FIG. 2 and the position signal generator 56 is associated with the gas-filled spring 22 of the central chair column 24 which forms the seat height adjusting device 62.

According to the circuit diagram in FIG. 1, the two position signal generators 54, 56 are connected to the control means 48 via electrical conductors 64 and 66. The position signals emitted by the relevant position signal generator can be stored in a position memory (fixed value memory) 68 connected to the control means and can be read out as desired.

Energy is supplied via solar cells 70 at the back of the back rest 18 which is connected by a conductor 72 to the control means 48 and through this to the other electrical components. Alternatively or in addition to the intermediate storage, the control means 48 may be connected via a line 74 to a storage battery 76. This can be incorporated into the seat 14.

The control means 48 is operated via a key pad 78 consisting, for example, of three keys 80 connected to the control means 48 by a conductor 82. In the example of embodiment shown, the key pad 78 is provided in the front portion of an arm rest 83 of one of the two arm rests 16.

Operation of the two adjusting devices 60, 62 when using the electrical control means 48 is briefly described hereinafter:

As also hitherto conventional with normal office chairs with lockable gas-filled springs, adjustment of the desired adjusted position requires bringing the chair into an initial seat adjusting position in which the gas-filled springs 22, 30 are displaying maximum extension. For this, the double-armed levers 32 and 34 (or the mechanical keys 32*a* and 34*a* indicated in FIG. 1 and corresponding to the respective function) are actuated when the chair is unloaded so that the appropriate locking device instantly moves into its released position while the relevant at least partially pressurized gas-filled spring extends to the piston rod to the greatest possible extent. As an alternative, an appropriate operation of keys of the key pad 78 can also electrically trigger the two gas-filled springs.

If, then, the person concerned takes his or her seat on the office chair and, for instance, releases the locking device of the height adjusting means, then under the weight of the person overcoming the spring force of the gas-filled spring the seat lowers until such time as the person reaches the desired height and releases the lever 34, so fixing the gas-filled spring in this position.

However, it is also possible to adopt as the initial adjusted position of the seat that position in which the gas-filled springs 22, 30 enjoy minimal extension. The person who sits on the office chair in the lowest position must then, after releasing the locking device, momentarily relieve the seat of the load so that under the spring force of the gas-filled spring the seat is again moved upwardly until the desired height position is reached and the person again releases the lever 34.

In order to store the particular height position which is desired, it is necessary firstly to activate the storage readiness of the circuit, particularly by actuating two or three keys on the key pad briefly one after another or simultaneously. Then, in the manner which has just been indicated, the desired new position is accessed and then, by pressure on a key, the desired new position is stored in the position memory by pressing the individual key associated with the respective person.

In a corresponding manner, it is also possible to adjust the optimum angle of inclination of the back rest in that, starting from an initial position in which the back rest is, for example, inclined as far as possible forwardly, the person sitting on the seat pushes it backwards (via the lever 32) against the spring force with the locking device released until it reaches the desired position, whereupon the person sitting on the seat releases the lever 32. By subsequently pressing the corresponding key on the key pad after prior activation, the setting at any given moment can be stored in the memory possibly at the same time as the adjusted height position.

The chair 10 can accordingly be brought by other persons into the optimum setting appropriate to these persons, the individual settings being stored.

The already stored settings are approached in the following way:

The office chair 10 is again brought into its initial seat adjusted position with, for example, gas-filled springs 22, 30 extended to the maximum degree. Then the person in question takes his position on the office chair and actuates the associated key on the key pad 78. Subsequently, the associated stored position signals for seat height adjustment and back rest rake adjustment are read out from the memory 68 by the control means 48 and are hereinafter treated as a desired value (should-be or set value) of the position signal. The position signals delivered from the two position signal generators 54 and 56 as actual values of the position signals are compared with the respective desired value and by an appropriate operation of the two electrical actuating elements 44, 46, the relevant locking device 40, 42 is moved out of its normal locked position into its released position in which it is maintained until the position signal actual value substantially corresponds to the position signal desired value. Then, the two actuating elements 44, 46 are without current switched by the control means 48 so that they are separated from the power source and the relevant locking device 40, 42 moves into its locking position. The office chair now is in its optimum setting for the person.

Alternatively, it is possible firstly to move the office chair into an initial seat adjusting position with the gas-filled spring 22 or 30 extended to the minimum extent in that the person concerned sits on the chair and maually or by appropriately operating the key pad moves the chair into the very lowest vertical position. Then, the person presses the respective memory key with the result that the corresponding locking device remains open only as long as the actual value is not equal with the desired value. To reach the desired height position, the corresponding person must relieve the load on the seat for a corresponding length of time so that under the force of the gas-filled spring, the seat is moved upwardly into the desired position.

The construction of the height adjusting device 62 in the region of the central chair column 24 is explained in greater detail hereinafter with reference to FIG. 3. The gas-filled spring 22 in this case is conventionally constructed with a piston rod 84 extended out in sealing-tight manner (gasket 86) from the bottom end of the cylinder 79, while at the inner end of the piston rod 84 a piston 88 is guided in sealing-tight manner (O-ring 90) in the cylinder 79. The piston 88 separates two partial spaces 92, 94 from each other. Both partial spaces 92, 94 are connected to each other by a communicating passage 98 which is normally closed by a shut-off valve 96. When the communicating passage 98 is shut off, the piston 88 is more or less retained in whatever position is occupied. If, instead of the gas-filled spring, a piston rod cylinder unit with a filling of pure liquid is used with an external spring element, for example a coil thrust spring, then with the shut-off valve 96 closed, the piston is rigidly fixed inside the cylinder. In the case of an at least partial filling of pressurized gas (either a filling of pure pressurized gas or a filling of liquid gas with one or a plurality of pressure gas bubbles, separated by diaphragms or auxiliary pistons), then with the shut-off valve 96 closed, there is a resilient yielding of the piston within the cylinder which improves seating comfort in that it assists the function of the cushions.

Figure 3:
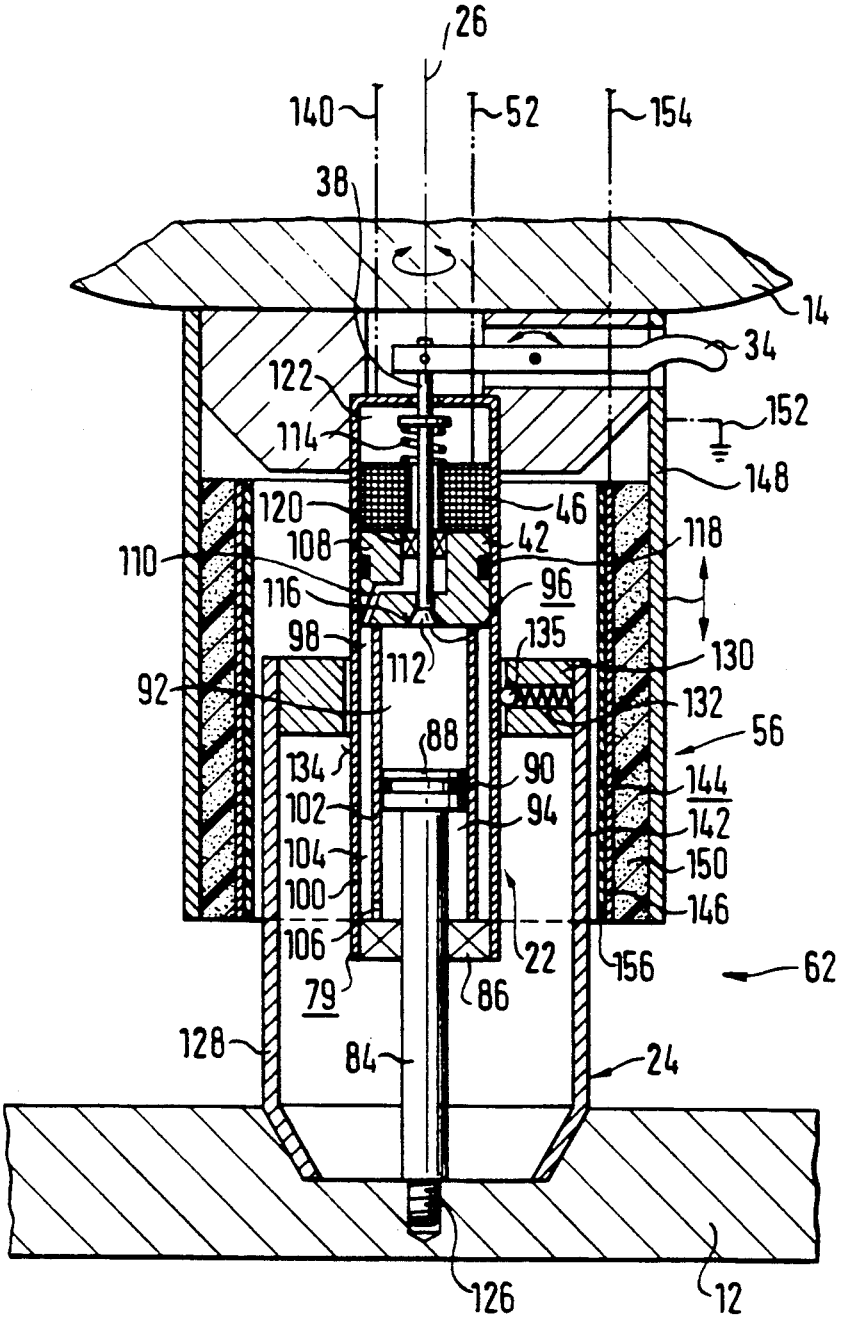
FIG. 3 is a partially sectional detailed view of the office chair according to FIG. 1 in the region of the seat height adjusting device.

The inner construction of the gas-filled spring 22 in FIG. 3 is only shown diagrammatically. The drawing shows the double-walled construction. Between the outer cylinder tube 100 and the inner cylinder tube 102, there is an annular space 104 which is a part of the communicating passage 98 with an outlet orifice 106 at the bottom end of the inner cylinder tube 102 into the annular partial space 94 around the piston rod 84. The shut-off valve 96 inserted into the outer cylinder tube 100, consists of a valve housing 108 which connects the upper partial space 92 within the inner cylinder tube 102 via an inner valve passage 110 with the annular space 104. The valve passage 110 is normally closed by the valve head 112 at the bottom end of the valve pin 38, for which purpose the head 112 is, under the initial tensioning force of the coil thrust spring 114, pressed against an inner cone 116 in the valve housing 108. The valve housing 108 is outwardly sealed (O-ring 118); similarly, the valve pin 38 is sealed by means of a packing 120 and is guided upwardly and out of the housing 108.

As already described hereinabove, the valve pin 38 can be actuated by means of the double-armed lever 34. Independent of this, the valve pin 38 can also be actuated by means of the lifting magnet which encloses the pin 38 and which forms the electrical actuating device 46. It is mounted in a space 122 in the outer cylinder tube 100 so that at the top it abuts the valve housing 104.

The bottom free end of the piston rod 84 is rigidly connected to the cruciform chair base 12 (threaded connection 126). A tubular pillar 128 which coaxially encloses the piston rod is likewise mounted on the cruciform chair base 12. This latter serves to protect the gas-filled spring 22 and may under certain circumstances serve as an additional vertical guide means. At the upper end of the tubular pillar there is a corresponding ring 130 on the inner periphery of the tubular pillar 128 which, with a minimal distance, surrounds the outer cylinder tube 100. The ring 130 is provided with a radial through bore 132 into which is inserted a sliding or rolling contact 134 which applies pressure to the outer periphery 135 of the cylinder 100, for an electrically conductive connection of the tubular pillar 128 to the cylinder tube 100. This latter is in turn connected to the control means 48 via a conductor 140 (as part of the conductor 64 in FIG. 1). In fact, the tubular pillar 128 serves as an inner hollow cylinder capacitor plate 142 of a capacitor of variable capacitance as part of the position signal generator 56. The other hollow cylinder capacitor plate 144 is formed by a copper foil 146. This is supported within a protective tube 148 mounted on the underside of the seat and carries an insulating layer 150 (a layer of polyurethane foam) as an intermediate lining. The protective tube 148 is earthed as indicated by an earthing wire 152. The copper foil is connected to the control means 48 via a conductor 154 (as a part of the conductor 64).

The inside of the copper foil 146 is provided with an insulating synthetic plastics film 156 (PTFE film polytetrafluoroethylene) which, by virtue of its dielectric properties also helps to increase the capacitance.

The tubular pillar 128 and the copper film 146 form a capacitor of variable capacitance since the degree of mutual overlap varies in accordance with the seat height position. In the example shown, the capacitance diminishes with the height of the seat. This variable capacitance may be part of an oscillating circuit within the control means 48, the resonance frequency of which varies accordingly with the capacitance. The resonance frequency can, for example, be ascertained by digital keying and then stored in accessible manner in the memory 68.

Also in the case of the back rest inclination adjusting device 60 according to FIG. 2, a plate capacitor of adjustable capacitance is formed, but in this case the inner capacitor plate is formed by the cylinder 170 of the gas-filled spring 30, while the outer capacitor plate is formed by a metal sleeve 172 connected to the outer end of the piston rod. In a manner similar to the metal sleeve 146 in FIG. 3, this is disposed in an earthed protective tube 178 with an interposed layer 174 of polyurethane foam. At the inner periphery of the metal sleeve 142 there is in turn an insulating dielectric synthetic plastics film 176. The metal sleeve 172 is connected to the control means 48 via a conductor 180; accordingly, the cylinder 170 is connected to the control means via a conductor 182.

The protective tube is fixed by an electrically insulating plate 184 on the outer end of the piston rod 186.

The outer end of the piston rod 186 is connected to a back rest support 188 which is in turn pivotally mounted at a distance therefrom and on the seat in a manner not shown in greater detail (axis 28). A corresponding pivotable mounting with a bearing axis 190 connects the opposite end of the gas-filled spring (the end of the cylinder 170 which is remote from the piston rod) to the seat. The operating lever 32 is articulated on the seat via a further pivot bearing (bearing axis 192) and, as already mentioned, makes it possible momentarily to release the locking device 40; the electrical actuating element 44 in the form of a lifting magnet permits of an independent actuation.

For ease of representation, FIG. 1 shows the bottom end of the back rest 188 as being laterally extended and being articulatingly connected to the piston rod 186 at the end which is thus extended.

With regard to FIG. 3, it should be added that the sliding or rolling contact 135 may be a ball biased by a spring (a snap-action device), in which case both the ball and also the pre-tensioning spring are metallically conductive in order to establish the desired electrical contact between the tubular pillar 24 and the cylinder tube 100.

While specific embodiments of the invention have been shown and described in detail to illustrate the application of the inventive principples, it will be understood that the invention may be embodied otherwise without departing from such principles.

What is claimed is:

1. An item of seating furniture comprising an electrically adjustable office chair, having at least one seat adjusting device (60, 62) for adjusting the seat height, with the seat adjusting device (60,62) comprising:

a spring element engaging two parts of the seat which have to be adjusted in respect of each other;

a locking device (40, 42) for the releasably locking the two seat parts in whichever adjusted position is chosen;

an electrical actuating element (44, 46) for the locking device (40, 42);

a manually operable electrical control means (48) connected to the electrical element (44, 46) for control of said seat adjustment device (60, 62);

a position signal generator (54, 56) connected to the control means (48) for generating a signal indicative of the relevant adjusted position (48); and a position memory (68) connected to the control means (48) for storing the position signal generated by the position signal generator (54, 56).

2. An item of seating furniture according to claim 1, wherein the position memory (68}is provided for storage and read out of at least two different position signals from the position signal generator (54, 56).

3. An item of seating furniture according to claim 1, wherein said electrical actuating element (44, 46) consists of a solenoid magnet.

4. An item of seating furniture according to claim 1, wherein solar cells (70) are provided to supply power for the at least one seat adjusting device (60, 62).

5. An item of seating furniture according to claim 4, wherein the solar cells (70) are disposed on the outside of a back rest.

6. An item of seating furniture according to claim 1, wherein a battery (76) is provided for supplying current to the at least one seat adjusting device (60, 62).

7. An item of seating furniture according to claim 7, wherein said battery (76) is chargeable by solar cells (70).

8. An item of seating furniture according to claim 1, wherein said spring element comprises a pressurized piston rod-cylinder unit.

9. An item of seating furniture according to claim 1, wherein said position signal generator (54, 56) comprises an electrical oscillating circuit of a capacitance or inductance which is variable as a function of the relevant adjusted position.

10. An item of seating furniture according to claim 9, wherein said position signal generator (54, 56) comprises a capacitor of variable capacitance consisting of two inter-engaged partially overlapping hollow cylinder capacitor plates (128, 156), one of said two plates being coupled for movement with one of said two seat parts and the other one of said two plates being coupled for movement with the other one of said two seat parts.

11. An item of seating furniture according to claim 10, wherein said spring element comprises a piston rod-cylinder unit and wherein both hollow cylinder capacitor plates (128, 156) are disposed coaxially of the piston rod-cylinder unit.

12. An item of seating furniture according to claim 11, wherein the inner capacitor plate is formed by the cylinder (170) of the piston rod-cylinder unit, while the outer capacitor plate is formed by a metal sleeve (172) connected to the outer piston rod end.

13. An item of seating furniture according to claim 11, wherein the inner capacitor plate is formed by a tubular pillar (128) connected to the outer end of the piston rod, while the outer capacitor plate is formed by a metal sleeve (146) connected to the end of the cylinder which is remote from the outer piston rod end.

14. An item of seating furniture according to claim 10, wherein the outer capacitor plate is disposed within an earthed protective tube (148, 178) with an insulating layer between the outer capacitor plate and the protective tube (148).

15. An item of seating furniture according to claim 14, wherein said metal sleeve (146, 172) is a copper foil.

16. An item of seating furniture according to claim 14, wherein the insulating layer is a foam layer (150, 174).

17. An item of seating furniture according to claim 10, wherein one of said capacitor plates is provided with an insulating coating.

18. An item of seating furniture according to claim 17, wherein said insulating coating is a PTFE coating.

19. An item of seating furniture according to claim 13, wherein said tubular pillar (128) is connected to the cylinder (100) of the piston rod-cylinder unit in an electrically conductive manner.

20. An item of seating furniture according to claim 19, wherein said tubular pillar (128) is connected to the cylinder (100) in electrically conductive manner via a sliding or rolling contact (135) which applies pressure to the outer periphery of the cylinder.

21. An item of seating furniture according to claim 1, wherein said spring element comprises a gas spring (22, 30) with an at least partial filling of pressurized gas, said gas spring (22, 30) comprising:

a cylinder closed at one axial end thereof and provided with a sealing and guiding unit for engaging a piston rod at the outer axial end thereof, a piston rod slidable within said cylinder and extending out from said cylinder at the other axial end of said cylinder, a piston provided on said piston rod within said cylinder, said piston separating two chambers (92, 94) within said cylinder from one another, a communicating passage (110) between said chambers (92, 94), and a shut-off valve (42) in the communicating passage (110).

22. An item of seating furniture according to claim 21, wherein said shut-off valve (42) is operable electrically and directly by manual operation.

23. An item of seating furniture according to claim 1, wherein said control means (48) is controlling a gas-filled spring (30) for adjusting the seat height and a gas-filled spring (22) for adjusting the angle of rake of a back rest.

24. An item of seating furniture according to claim 1, wherein a key pad (78) for operating the at least one seat adjusting device (60, 62) is connected to the control means (48).

25. An item of seating furniture according to claim 24, wherein said key pad (78) is integrated into an arm rest (83).

26. An item of seating furniture according to claim 24, wherein upon actuation of a first selected key on the key pad (78) the position signal of the respective position signal generator (54, 56) is stored in the position memory (68) as a position signal should-be value, wherein upon actuation of a second key selection of the key pad (78) the respective stored should-be value of the position signal is read out and is compared with an actual value of the position signal which is generated at that moment by the position signal generator and wherein the locking device (40, 42) is moved by the electrical actuating element (44, 46) out of its locked position and into its released position and is held in the released position until, in the course of the adjusting movement of the at least one seat adjusting device (60, 62), the actual value of the position signal corresponds substantially to the should-be value of the position signal.

* * * * *

UNITED STATES PATENT AND TRADEMARK OFFICE

CERTIFICATE OF CORRECTION

PATENT NO. : 5,090,770

DATED : February 25, 1992

INVENTOR(S) : Heinz-Josef Heinrichs et al

It is certified that error appears in the above-indentified patent and that said Letters Patent is hereby corrected as shown below:

Column 10, line 7, "for the" should read --for--

Column 10, line 37, "claim 7" should read --claim 6--.

Signed and Sealed this

Fourth Day of January, 1994

Bruce Lehman

*Attest:*

BRUCE LEHMAN

*Attesting Officer*

*Commissioner of Patents and Trademarks*